United States Patent [19]

Hock

[11] 4,149,809

[45] Apr. 17, 1979

[54] TYPEWRITER SPIRAL DISC PRINTER

[75] Inventor: Allan G. Hock, New Milford, Conn.

[73] Assignee: SCM Corporation, New York, N.Y.

[21] Appl. No.: 873,021

[22] Filed: Jan. 27, 1978

[51] Int. Cl.[2] ..... B41J 1/30

[52] U.S. Cl. ..... 400/144.3; 400/173

[58] Field of Search ..... 101/93.16–93.19; 400/144.2–144.3, 173–175

[56] References Cited

U.S. PATENT DOCUMENTS

| | | | |
|---|---|---|---|
| 2,236,663 | 4/1941 | Adams | 400/144.2 |
| 3,356,199 | 12/1967 | Robinson | 400/144.3 |
| 3,371,766 | 3/1968 | Staller | 400/144.3 |
| 3,884,339 | 5/1975 | Castoldi et al. | 400/144.3 |

OTHER PUBLICATIONS

IBM Tech. Disc. Bulletin, "On the Ply Print Wheel Employing Wide Face Hammer", J. H. Meier et al., vol. 16, No. 6, Nov. 1973, pp. 1689–1692.

*Primary Examiner*—Paul T. Sewell

*Attorney, Agent, or Firm*—Ernest F. Weinberger; Milton Wolson

[57] ABSTRACT

A rotatable disc type printer for use in conjunction with a typewriter having a movable carrier. The type element or characters are carried on radially extending petals and are arranged at varying distances from the center of disc rotation so as to define a circumferential spiral path. The angular placement or position of each petal or spoke is determined by the following formula: angular placement of $i^{th}$ petal $=360°/n \pm \tan^{-1} id/nL$ where n defines the total number of petals, d is the character spacing and L is the minimum distance from the center of disc to the print point. The length or distance from the center of disc rotation to the type character or element is defined by: $L_i$ (length for $i^{th}$ element- $=\sqrt{i\,L^2+(i/nd)^2}$ where i/nd ids the linear distance of travel of the disc center while rotating from a home position to the position for printing the character carried by the $i^{th}$ petal. In addition, the vertical center line of each type character is angularly displaced from the petal center line by an angle equal to $\tan^{-1} id/nL$ ($i^{th}$ element). In essence the disc rotates and linearly moves along a path parallel to the typewriter platen while printing one character for each complete rotation thereof along a line of type vertically displaced above the path of the disc center. Preferably the print point is in vertical alignment with the disc center when in the home position. A plurality of petals are deleted to permit visual observation of the last typed character.

2 Claims, 4 Drawing Figures

TYPEWRITER SPIRAL DISC PRINTER

The present invention relates to typewriters and more particularly to rotary disc print wheels for use in conjunction with typewriters wherein the print wheel rotates and linearly translates in a path parallel to the typewriter platen axis. One character is typed for each full rotation and advance of the print wheel. The print wheel assumes or passes through the home position prior to the next print cycle.

In the field of high speed printers employing spiral print wheels carrying characters to be printed on the periphery of the wheel spokes or petals, it has been the general practice to print on-the-fly, without any interruption during each cycle of line printing. Such high speed printers have found utility in computer technology and data processing. These print wheels are, however, not satisfactory for use in typewriters in that they do not permit visual observation of the last printed character but rather the entire preceding line. In addition, the angular positioning of the character with respect to the print wheel center does provide a line-of-type that meets the typewriter industry standard of correspondence quality. In general the extremely stringent specifications for horizontal, vertical and angular placement of the typed character cannot be met by presently used print wheels as exemplified by U.S. Pat. Nos. 3,371,766; 2,236,663; and 3,356,199.

SUMMARY OF THE INVENTION

The general purpose of this invention is to provide a sprial daisy print wheel for a typewriter in which the wheel simultaneously rotates and linearly translates and that has all the advantages of similarly employed prior art devices and has none of the disadvantages thereof. To attain this, the present invention provides a spiral print wheel having a unique positioning and arrangement of the type elements on the print wheel spokes whereby the resulting printed line-of-type meets the industry standard of correspondence quality.

An object of the present invention is to provide a print wheel suitable for use with a typewriter and capable of meeting the typing standard required in the art.

Another object is to provide a print wheel for a typewriter wherein the last typed character is visible and the print point is approximately vertically disposed above the wheel center in the home position.

Other objects and many of the attendant advantages of this invention will be readily appreciated as the same becomes better understood by reference to the following detailed description when considered in connection with the accompanying drawings.

DESCRIPTION OF THE PREFERRED EMBODIMENT

Figure 1:
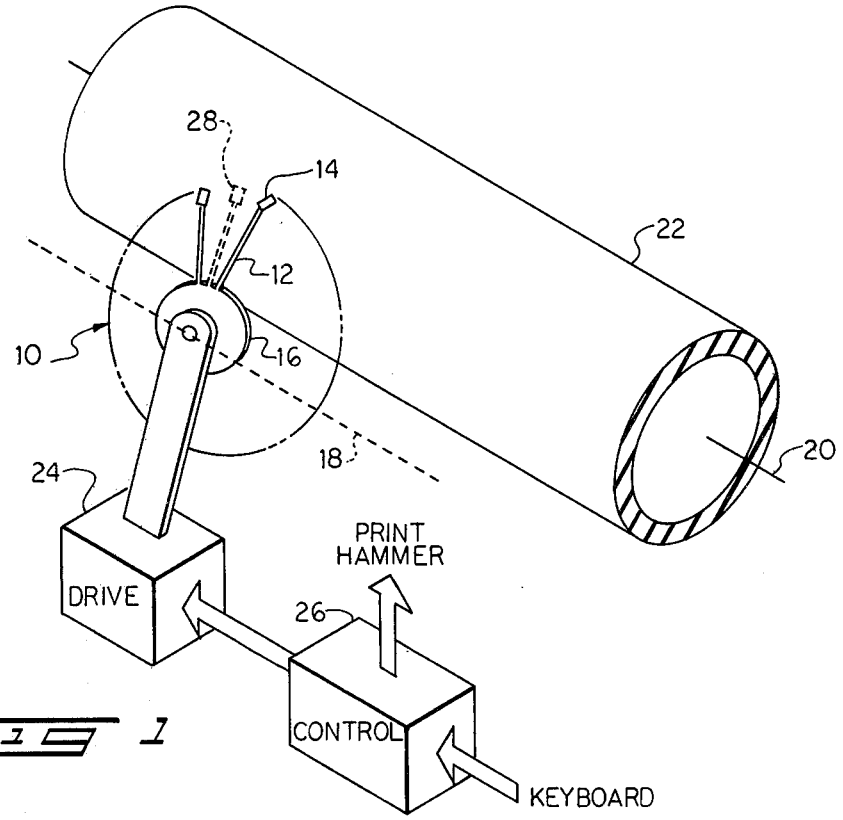
FIG. 1 is a perspective view of the spiral print wheel made in accordance with the principle of this invention and its relationship to the platen of a typewriter.

In the illustration of FIG. 1 the spiral print wheel 10 has extending, radially from its center, a plurality of resilient spokes or petals 12 which carry at the ends thereof characters or symbols 14 to be typed. The print wheel 10 is centrally supported for rotation about its center hub 16 and for linear displacement along an axis 18 parallel to the axis 20 of a typewriter platen 22. The print wheel 10 is coupled to a drive means 24 which may be in the form of a single motor for simultaneously imparting both rotational and linear motion thereto. The particular mechanism and structural supports for the wheel, as well as the drive means 24 have not been illustrated since these are well known in the printer art and suitable structures for this purpose are described in the hereinbefore cited patents. A control device 26, connected to the drive means 24, receives print information from a keyboard and provides an input for the drive means 24 so as to rotate the print wheel one full cycle for each character space of printing. In addition, the control device 26 provides information to trigger a print hammer (not shown) for impacting and printing the selected character when it is at the print point 28. In one suitable arrangement, the print wheel, and the print hammer are supported on a moving carrier with the hammer disposed proximate the wheel print point 28.

The foregoing generally defines the environment in which print wheels are employed and does not constitute any part of this invention. All that is basically necessary for operation of the print wheel of this invention, in conjunction with a typewriter, is that it be provided with simultaneous rotational and linear movement in line with the platen and that the hammer impact the selected print wheel petal or spoke at the proper instant during the movement of the wheel through a print cycle.

It is known that by simultaneously rotating and translating a print wheel, the complexity and the number of components can be reduced and the resulting printing operation can be made continuous either for an entire line of print or between print cycles. However, when the foregoing concept is applied to a typewriter, as opposed to a continuous on-the-fly-high speed printer, provision must be made for individual character visibility by the operator and for an extremely fine correspondence quality of print.

In order to provide a high quality of print for a wheel that simultaneously rotates and moves linearly it is necessary to apply three transformations to a simple, symmetrical circular print wheel. Two transformations to the petals and one to the orientation of the character or symbol carried by the petal.

The first transformation considered relates to the angular displacement of each petal. Since it is desired to print anyone of the characters carried by the petals at a single print point for each complete revolution of the wheel, it is necessary to compensate for the linear movement of the wheel center. The wheel center moves a distance, d, equal to the spacing between the centers of the printed characters (letter space), for each full revolution of the wheel.

The term "petal length" referred to hereinafter is defined as the distance between the center of the print wheel and the center of the type character carried by that petal.

Figure 2:
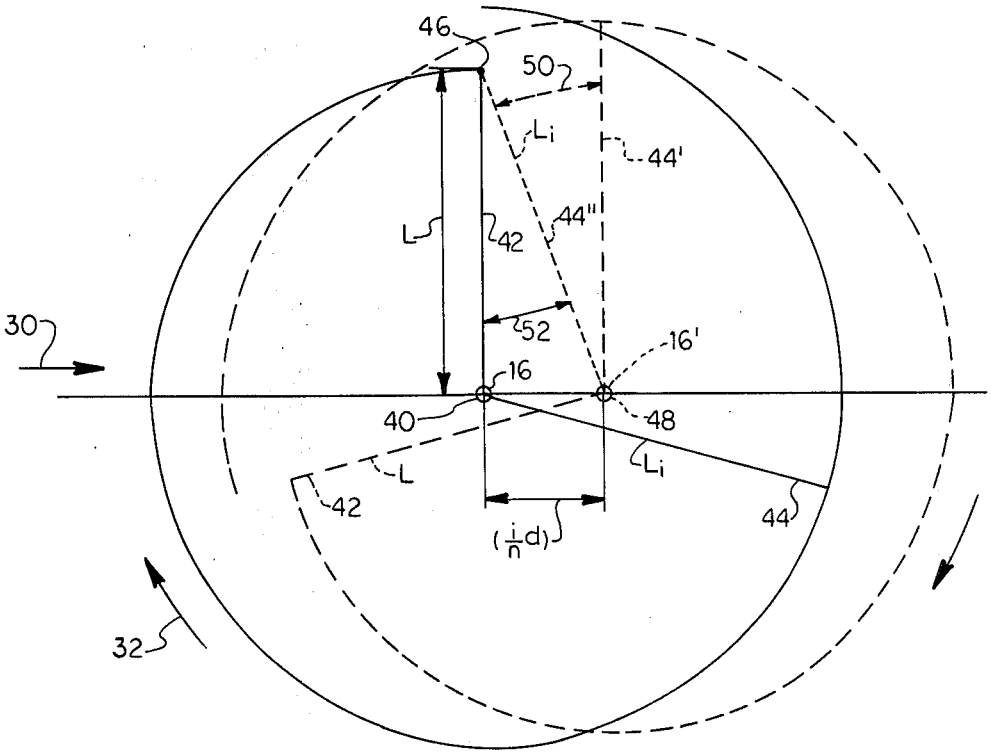
FIG. 2 is a simplified diagram employed in explaining the print wheel physical parameters.

The foregoing transformation is clearly illustrated in FIG. 2 wherein the spiral print wheel is shown in solid line at its home position and in dashed line at a position for printing the character carried by the $i^{th}$ petal 44. Arrow 30 represents the linear direction of movement of the wheel and arrow 32 the direction of rotation. For the sake of clarity all the wheel petals have been deleted except for the first or shortest petal 42 and the $i^{th}$ petal 44. In the print start or home position the shortest or first possible petal 42 is vertical and its character is at the print point 46. The print wheel drive is now activated to print the character carried by the $i^{th}$ petal and the wheel is linear advanced and rotated so that its center is now at 48. Assuming the wheel carries, n, equally spaced petals, then it will have rotated i/n 360° wherein the $i^{th}$ petal 44 assumes a vertical position directly above the center 16 at 48. In order for this petal to position its character at the print point 46, the petal 44 (center line) must be angularly displaced in a direction opposite rotation by an angle 50 which is equal to angle 52. Angle 52, from the geometry, is $\tan^{-1}$ (i/n)d/L. FIG. 2 has not been drawn to scale and the separation between the wheel centers at points 40 and 48 has been substantially enlarged so that angle 52 is greatly out of proportion and not necessarily a true representation.

It should be noted that dependent on the direction of print wheel rotation with respect to the direction of the angular linear motion displacement of the petals is either clockwise or counterclockwise. In FIG. 2 the rotation is clockwise and the direction of motion is to the right and the angular displacement is clockwise. Under these conditions it is clear that at least one petal must be removed to accommodate these displacements. Where the print wheel moves to the left and the rotation is counterclockwise, the displacement is counterclockwise and one or more additional petal can be added.

The second transformation to be considered relates to the petal element length. Referring again to the geometry of FIG. 2, the length of the $i^{th}$ petal 44'' $L_i$, is equal to $\sqrt{L^2+(i/n\ d)^2}$ where (i/n d) is the displacement of the print wheel center for printing of the character carried by the $i^{th}$ petal. Lengthening the print wheel petals in accordance with the foregoing provides a spiral print wheel.

The essential third transformation entails the angular canting of the character carried by the petal with respect to the petal radial center line. In a circular print wheel where the center of the wheel is always directly below the print point, the characters all have their vertical axis in alignment with the center line of the radially extending petals. On the other hand, where the print wheel center is not vertically aligned with the print point during the printing of a selected character it is necessary to angularly cant the character axis with respect to the petal center line.

Figure 3:
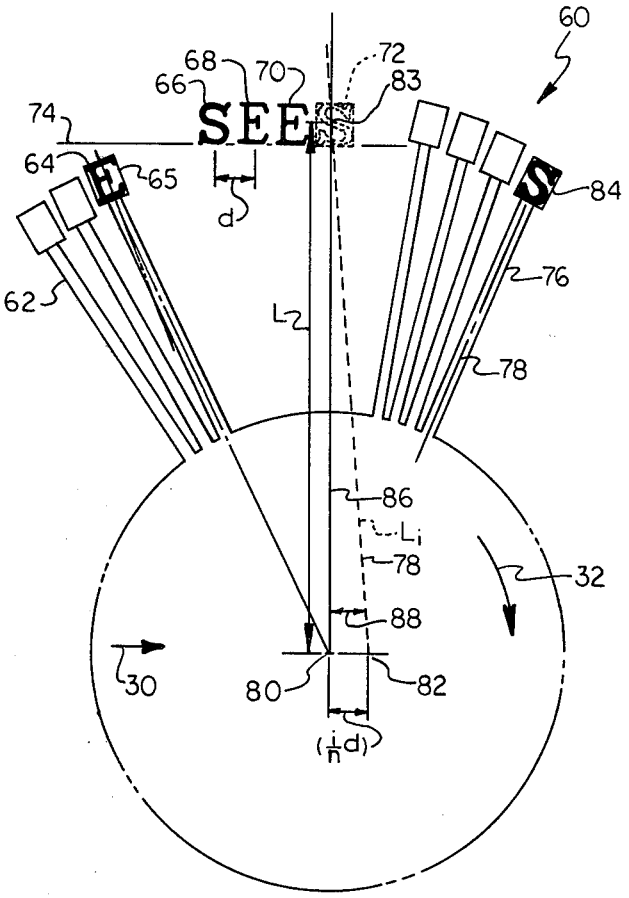
FIG. 3 is a partial view of a print wheel made in accordance with the principle of this invention showing the canting of the font characters.

Referring now to FIG. 3 the spiral print wheel 60 includes a plurality of radially extending petals 62 each of which carries at its free end one of a font of type characters 64 within windows 65. The print wheel is illustrated in its home position after having typed the characters 66, 68 and 70. The next area on which a character will be typed is represented by the print point 72. In order to provide visual observation of previously typed characters (i.e. 66–70) a plurality of petals have been deleted from the wheel. These deleted petals, with reference to the home position, include all those to the left of the print point 72 (opposite to direction of linear motion) whose type characters might obstruct previously type characters. In other words, the type characters on the left of the print point should lie below the bottom of the writing line 74. Likewise, petals lying to the right of the print point and proximate thereto have been deleted.

Figure 4:
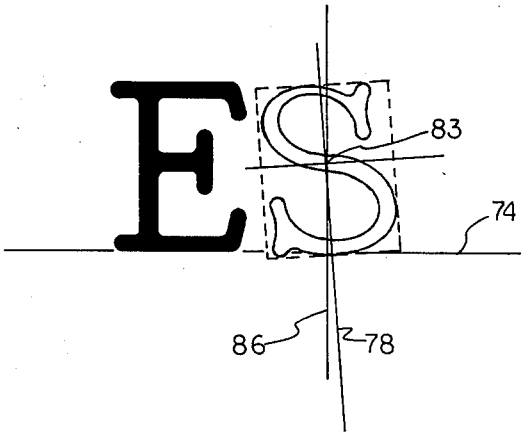
FIG. 4 is a partial view of the print point.

Assuming that the next character to be typed is the letter "S" carried by the $i^{th}$ petal 76 whose radial center line lies along line 78. The print wheel 60, upon activation of the drive means, rotates while its center 80 moves to point 82. In this position, the center 83 of the letter "S" and the window 84 will be aligned with the center of the print point area 72 due to the previously described angular petal displacement and petal length. If, however, the character center line 86 is in-line with the petal center line, the character printed will be slightly askew with respect to the writing line 74. The foregoing is illustrated in FIG. 4.

In order to correct this error, it is necessary to rotate or cant each of the characters with respect to its petal center line. Referring again to FIG. 3 there is shown, in particular, the correct placement and orientation of the letter "S" at the print point. The petal center line 78, whose length has been designated $L_i$, intersects the window (letter) center 83 at the print point center. The print point center line 86 can be considered the center line of the shortest or first petal whose length would be L as previously noted. From the geometry of FIG. 3, in order to properly orient the $i^{th}$ character, in this case the letter "S", the center line of the character must overlay the print point center line 86. Therefore, the angle 88 between the character center line 86 and the print point center line is the angle through which the character was rotated with respect to the petal center line to assume this correct orientation. Angle 88 is the $\cos^{-1}L_i$ or $\tan^{-1}$ id/nL for the $i^{th}$ petal.

In summary, by constructing a spiral print element in accordance with the foregoing transformation the element will be readily capable of providing correspondence quality printing.

It should be understood, of course, that the foregoing disclosure relates to only a preferred embodiment of the invention and that numerous modifications or alterations may be made therein without departing from the spirit and the scope of the invention as set forth in the appended claims.

I claim:

1. A spiral print element for a typewriter wherein said element is rotated one full revolution and linearly moved one character space, d, from a home position for each print cycle, for printing at a print point vertically disposed above the center of said element, said element comprising:

a rotatable wheel having a plurality of, n, radially extending petals, each of said petals carrying a type character;

said type characters being radially disposed from the center of said wheel a distance, $L_i=\sqrt{L^2+(i/n\ d)^2}$, wherein $L_i$ is the distance from the wheel center to the type character center carried by the $i^{th}$ petal, and L is the distance from the wheel center to the print point when said wheel is in the home position;

said petals being angularly disposed about said wheel at angles defined by $360°/n \pm \tan^{-1}$ id/nL, and each of said type character being canted with respect to the petal carrying said type character by an angle $\tan^{-1}$ id/nL;

whereby there is provided a spiral print element capable of correspondence quality printing.

2. The print element as defined in claim 1 wherein those of said petals proximate said home position are deleted to provide immediate visual observation of the previously printed character.

* * * * *